US006752090B2

(12) United States Patent
Schenker et al.

(10) Patent No.: US 6,752,090 B2
(45) Date of Patent: Jun. 22, 2004

(54) FOLDING DESK

(75) Inventors: David A. Schenker, Cedarburg, WI (US); Brett J. Vladika, Milwaukee, WI (US); Jesse D. Cotterman, Grafton, WI (US); Brian J. Munzel, Port Washington, WI (US); Mark M. Gondek, Milwaukee, WI (US)

(73) Assignee: Innovative Storage Designs, Inc., Mequon, IL (US)

( * ) Notice: Subject to any disclaimer, the term of this patent is extended or adjusted under 35 U.S.C. 154(b) by 0 days.

(21) Appl. No.: 10/139,945

(22) Filed: May 6, 2002

(65) Prior Publication Data

US 2003/0177960 A1 Sep. 25, 2003

Related U.S. Application Data

(60) Provisional application No. 60/366,562, filed on Mar. 22, 2002.

(51) Int. Cl.[7] ..... A47B 3/00

(52) U.S. Cl. ..... 108/115

(58) Field of Search ..... 108/50.01, 50.02, 108/115, 153.1, 156.12, 157.12; 312/223.6, 195, 196

(56) References Cited

U.S. PATENT DOCUMENTS

| | | | | |
|---|---|---|---|---|
| 1,549,146 A | | 8/1925 | Miner | |
| 2,750,243 A | * | 6/1956 | Zielfeldt | 108/115 |
| 2,936,896 A | | 5/1960 | Friedman | |
| 3,322,077 A | | 5/1967 | Kovacik | |
| 3,527,174 A | * | 9/1970 | Lay | 108/115 |
| 5,337,657 A | * | 8/1994 | Diffrient | 108/115 |
| 5,904,104 A | * | 5/1999 | Yu | 108/115 |
| 5,927,214 A | * | 7/1999 | Schwartz et al. | 108/128 |
| 5,934,201 A | * | 8/1999 | Diffrient | 108/50.02 |
| 5,974,985 A | * | 11/1999 | Flototto et al. | 108/157.18 |
| 5,997,113 A | * | 12/1999 | Benson | 108/115 |
| 6,170,407 B1 | * | 1/2001 | Hayward | 108/50.02 |
| 6,182,724 B1 | | 2/2001 | Chou et al. | |
| 6,257,153 B1 | | 7/2001 | Portugal | |
| 6,415,723 B1 | * | 7/2002 | Kopish et al. | 108/50.02 |

FOREIGN PATENT DOCUMENTS

JP 5-337011 * 12/1993

* cited by examiner

*Primary Examiner*—Jose V. Chen
(74) *Attorney, Agent, or Firm*—Michael Best & Friedrich LLP

(57) ABSTRACT

A foldable desk having a working condition and a folded condition. The foldable desk includes a desk top, a plurality of legs and a shelf. The desk top includes a cord managing aperture that permits cords to pass through the desk top when the desk is in the working condition and is useable as a handle when the desk is in the folded condition. The desk top can move between a first orientation when the desk is in the working condition and a second orientation when the desk is in the folded condition. The plurality of legs are coupled to the desk top to support the desk top in the working condition. The plurality of legs lie in a single plane in the folded condition and do not lie in a single plane in the working condition.

39 Claims, 9 Drawing Sheets

FOLDING DESK

This application claims the benefit of U.S. Provisional Patent Application No. 60/366,562, filed Mar. 22, 2002.

BACKGROUND

The invention relates to a desk and, more particularly, to a folding desk.

There are several types of desks that exist. Most of these desks are stationary desks that maintain a single shape after being assembled. Many of the stationary desks are bulky, heavy and difficult to maneuver.

There are also several types of foldable devices such as foldable serving carts, foldable tables and foldable work benches. These foldable devices typically have a folded condition and an unfolded condition. Many of the foldable devices require many steps to move the foldable device between the folded and unfolded conditions. Many of the foldable devices are also bulky in the folded condition making storage and transport of the foldable devices difficult.

Other foldable devices require assembly and disassembly of the device to move between the folded and unfolded conditions. Disassembling the foldable devices creates several unconnected elements that may be misplaced or separated from the other elements. Also, transportation of the unconnected elements is difficult and time consuming.

SUMMARY

The invention provides a foldable desk having a working condition and a folded condition. The foldable desk includes a desk top, a plurality of legs and a shelf. The desk top can move between a first orientation when the desk is in the working condition and a second orientation when the desk is in the folded condition. The plurality of legs are coupled to the desk top to support the desk top in the working condition. The plurality of legs lie in a single plane in the folded condition and do not lie in a single plane in the working condition. The shelf is substantially parallel to the desk top in the working condition and the folded condition. The plurality of legs can be positioned between the desk top and the shelf in the folded condition. The desk top includes a cord managing aperture that permits cords to pass through the desk top when the desk is in the working condition. The cord managing aperture is also useable as a handle when the desk is in the folded condition.

Other features and advantages of the invention will become apparent to those skilled in the art upon review of the following detailed description, claims, and drawings.

Figure 1:
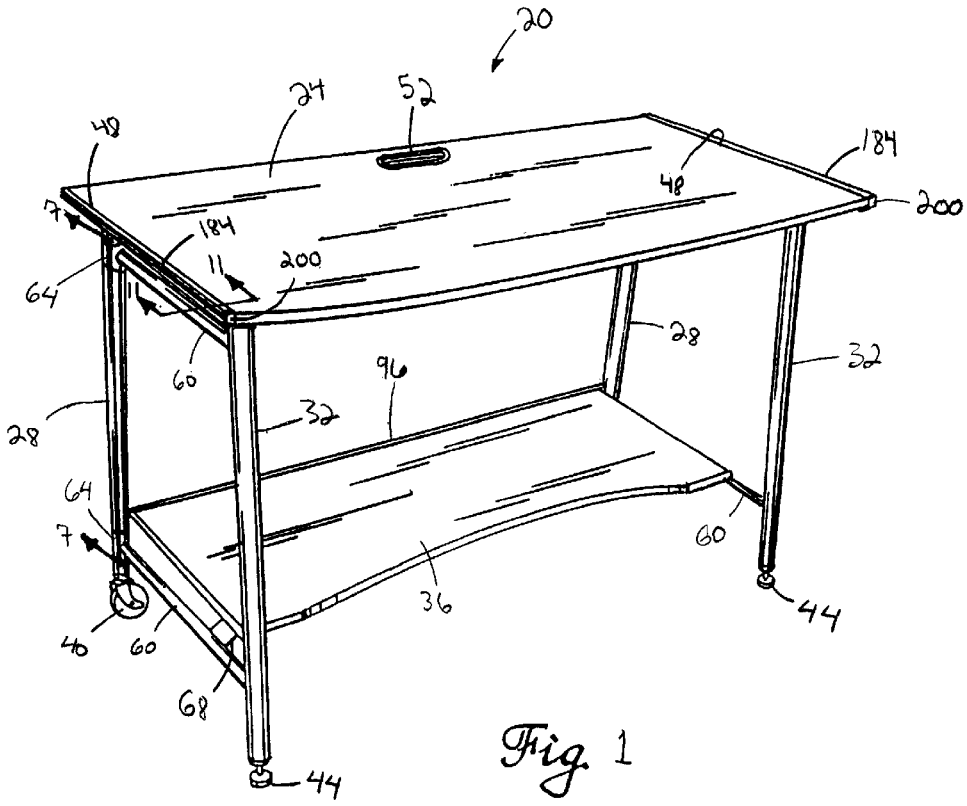
FIG. 1 is a top perspective view of a folding desk embodying the invention.

Before one embodiment of the invention is explained in detail, it is to be understood that the invention is not limited in its application to the details of construction and the arrangements of the components set forth in the following description or illustrated in the drawings. The invention is capable of other embodiments and constructions and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

Figure 2:
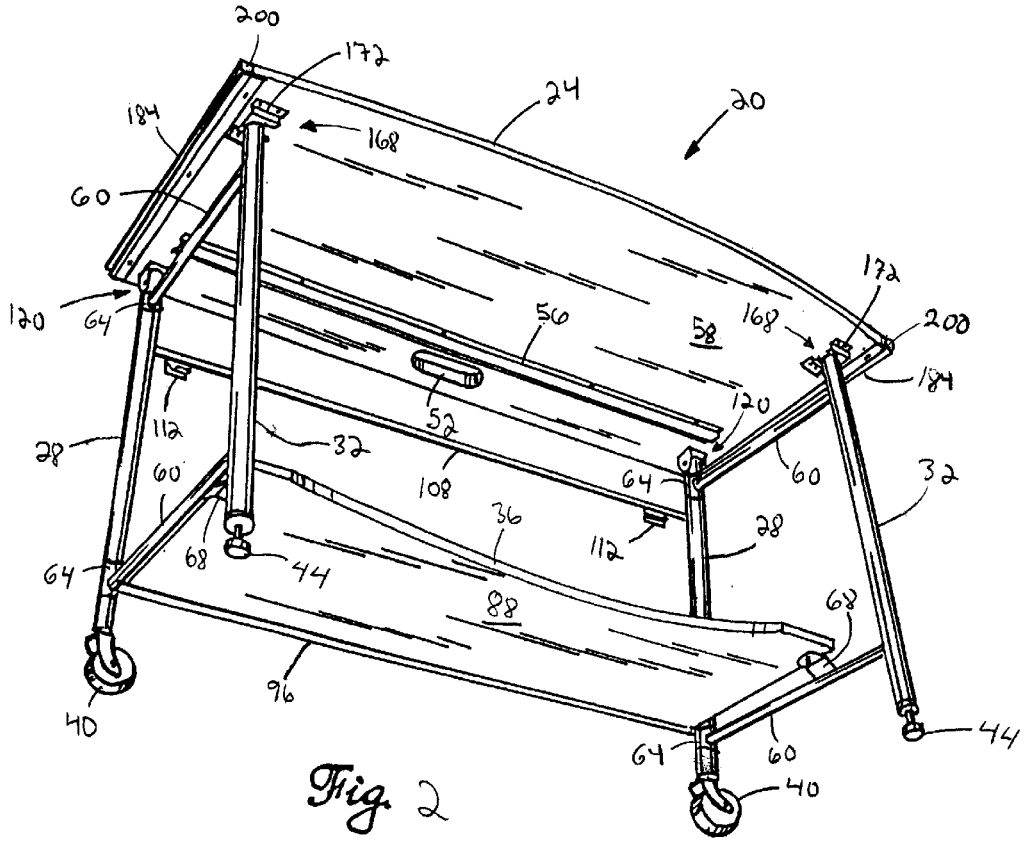
FIG. 2 is a bottom perspective view of the folding desk.
Figure 3:
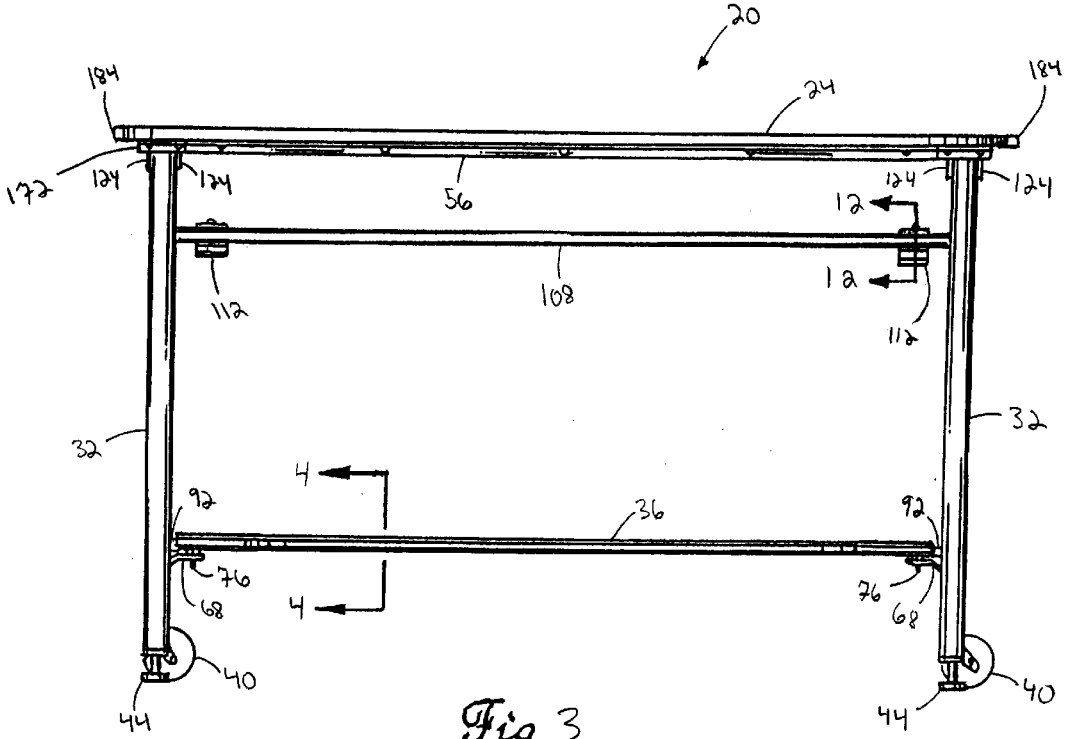
FIG. 3 is a front view of the folding desk.
Figure 4:
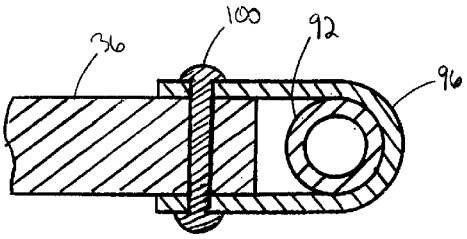
FIG. 4 is an enlarged cross-section view along line 4—4 in FIG. 3.
Figure 5:
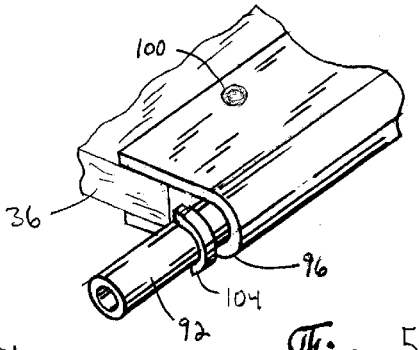
FIG. 5 is an enlarged top perspective view of a portion of the folding desk.

FIGS. 1–3 illustrate a folding desk 20 in a working condition. The folding desk 20 and its various parts are also movable into a folded condition illustrated in FIGS. 15–17 and described in more detail below.

With reference to FIGS. 1–3, the folding desk includes a desk top 24 supported by two rear legs 28 and two front legs 32. The desk 20 further includes a shelf 36 positioned under the desk top 24, wheels 40 mounted to the rear legs 28, and height adjustment pads 44 mounted to the front legs 32 for leveling the desk top 24 with respect to the ground surface on which the folding desk 20 sits.

The desk top 24 has side surfaces 48 and includes a cord managing aperture 52 that permits cords (e.g., from a computer or other electronic device) to pass through the desk top 24. A support rib 56 is mounted to a bottom surface 58 of the desk top 24 for providing additional strength and support to the desk top 24.

Figure 13:
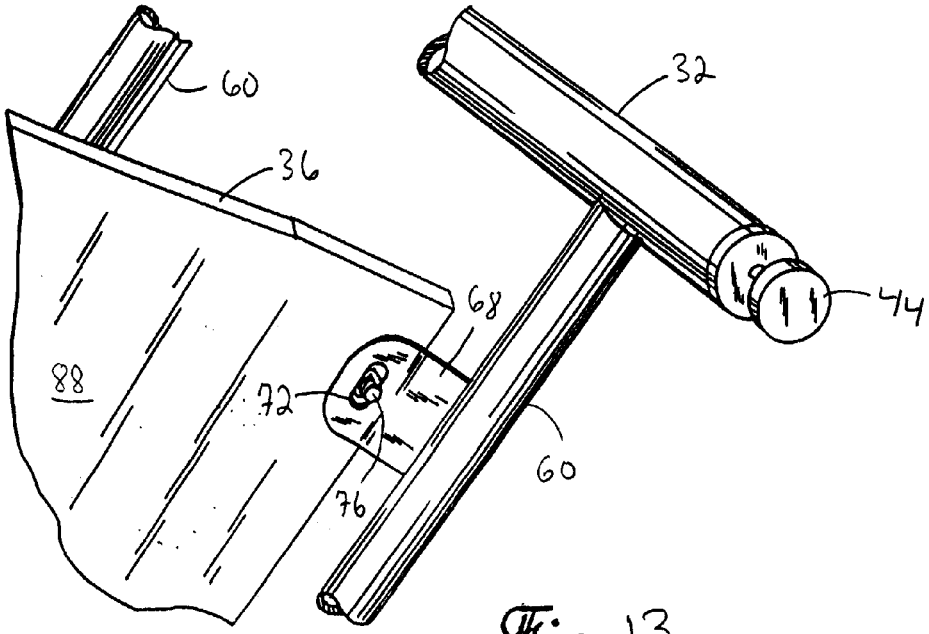
FIG. 13 is an enlarged bottom perspective view of a portion of the folding desk.
Figure 14:
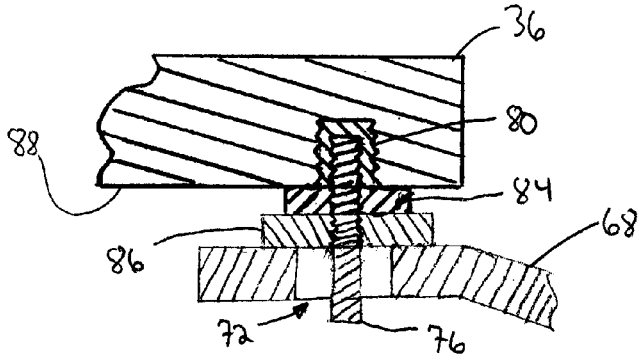
FIG. 14 is a cross-section view of a support bracket, an anchor, a pin and other portions of the folding desk.

A plurality of cross members 60 extend between respective front and rear legs 32, 28 and are pivotally coupled to the rear legs 28 by way of collars 64 so that the front legs may pivot about the rear legs 28 (as discussed below). A support bracket 68 is mounted to each of the lower cross members 60 and extends underneath the shelf 36 for supporting the shelf 36 thereon. Each support bracket 68 includes a slot or an aperture 72 therein for receiving a pin 76 mounted to the shelf 36 (illustrated best in FIGS. 13 and 14). The pin 76 is threaded into an anchor 80 mounted to the shelf 36 and secured to the shelf 36 by two fasteners 84, 86 such as nuts (illustrated best in FIG. 14). The pin 76 extends from a bottom surface 88 of the shelf 36 and through the aperture 72 such that the front legs 32 are substantially locked in place with respect to the rear legs 28.

With reference to FIGS. 1–5, a pivot bar 92 is mounted to a back side of the rear legs 28 and extends in a direction substantially parallel to the desk top 24. A u-shaped bracket 96 partially wraps around the pivot bar 92 and is mounted to the shelf 36 by fasteners 100 to enable the shelf 36 to pivot about the pivot bar 92. Stoppers 104 are mounted to the pivot bar 92 to prevent the u-shaped bracket 96 from substantially sliding horizontally along the pivot bar 92.

Figure 12:
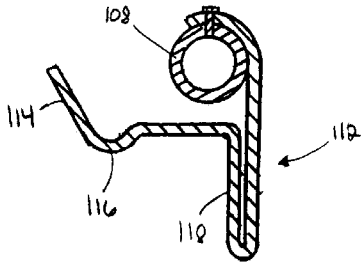
FIG. 12 is a cross-section view along line 12—12 in FIG. 3.

With reference to FIGS. 2, 3 and 12, a cross beam 108 is mounted to the back side of the two rear legs 28 and extends substantially parallel to the pivot bar 92 and the desk top 24. Resilient clips 112 are mounted to the cross beam 108 for resiliently holding the shelf 36 when the desk 20 is in the folded condition. Each resilient clip 112 includes a camming surface 114, a limiting surface 116 and a back surface 118. When moving the shelf 36 from the working condition to the folded condition, the shelf 36 contacts the camming surface 114 and biases the camming surface 114 and limiting surface 116 upward until the shelf 36 passes the limiting surface 116. The camming and limiting surfaces 114, 116 move downward to trap the shelf 36 between the limiting surface 116 and the back surface 118 in the folded condition.

Figure 6:
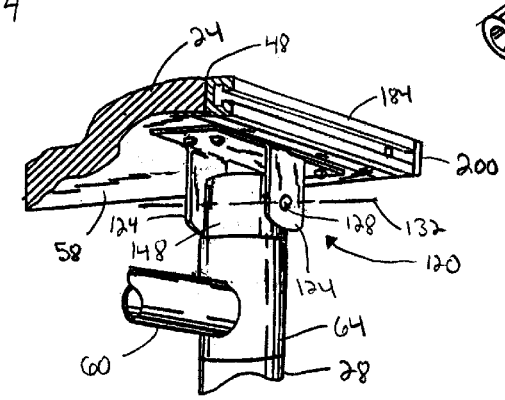
FIG. 6 is an enlarged bottom perspective view of a portion of the folding desk.

Referring to FIG. 6, a yoke bracket 120 is mounted to the bottom surface 58 of the desk top 24 for mounting one of the rear legs 28 to the desk top 24. The other of the rear legs 28 is mounted to the bottom surface 58 of the desk top 24 by a similar yoke bracket 120, therefore, only one yoke bracket will be discussed herein. The yoke bracket 120 includes two side flanges 124, each having an aperture defined therein. A pin 128 pivotally connects the yoke bracket 120 and the rear leg 28 by extending along an axis 132 through the apertures in the flanges 124 and through the rear leg 28 such that the desk top 24 is pivotal about the axis 132 with respect to the rear leg 28. The axis 132 extends substantially parallel to the desk top 24. The axis 132 also extends through the other yoke bracket 120, pin 128, and rear leg 28 in a fashion similar to that discussed above. The space between the tops of the rear legs 28 and the bottom surface 58 of the desk top 24 provides sufficient clearance for the desk top 24 to pivot about the axis 132 between the working and the folded conditions.

Figure 7:
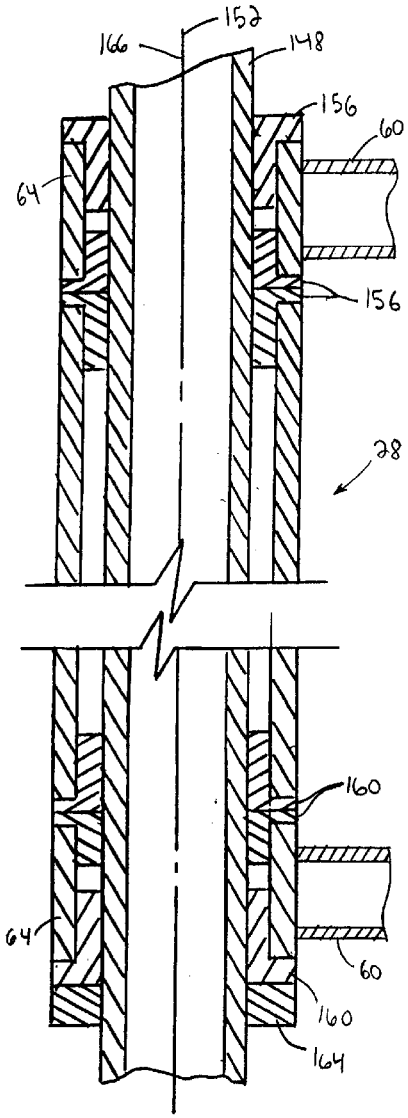
FIG. 7 is a cross-section view along line 7—7 in FIG. 1.

With additional reference to FIG. 7, the rear leg 28 includes a central rod 148 defining a rear leg longitudinal axis 152, upper inserts 156 for pivotally supporting the upper collar 64, lower inserts 160 for pivotally supporting the lower collar 64, and a support collar 164 mounted to the central rod 148 to prevent the inserts 156, 160 and collars 64 from sliding downward along the central rod 148. In the illustrated construction, the front legs 32 pivot between the folded and working conditions about a pivot axis 166 that is collinear with the rear leg longitudinal axis 152.

Figure 8:
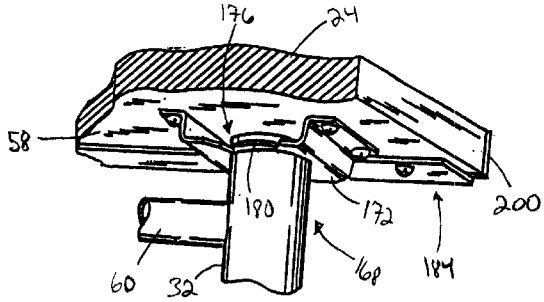
FIG. 8 is an enlarged bottom perspective view of a portion of the folding desk.
Figure 9:
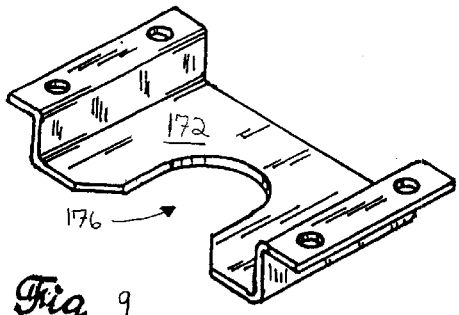
FIG. 9 is a top perspective view of a mounting bracket.

Referring to FIGS. 8 and 9, a slot-and-groove connection 168 is illustrated for releasably securing one of the front legs 32 to the desk top 24. The other of the front legs 32 is releasably mounted to the desk top 24 by a similar slot-and-groove connection 168, therefore, only one slot-and-groove connection 168 will be discussed herein. The slot-and-groove connection 168 includes a mounting bracket 172 having a slot 176 defined therein and a groove 180 defined in the front leg 32. The mounting bracket 172 is mounted to the bottom surface 58 of the desk top 24 and the groove 180 is engageable with the mounting bracket 172 to prevent the desk top 24 from moving upward away from the front leg 32 in the working condition. Alternatively, the mounting bracket 172 having the slot 176 may be mounted to the top of the front leg 32, and a member having the groove 180 may depend from the bottom surface 58 of the desk top 24.

Figure 10:
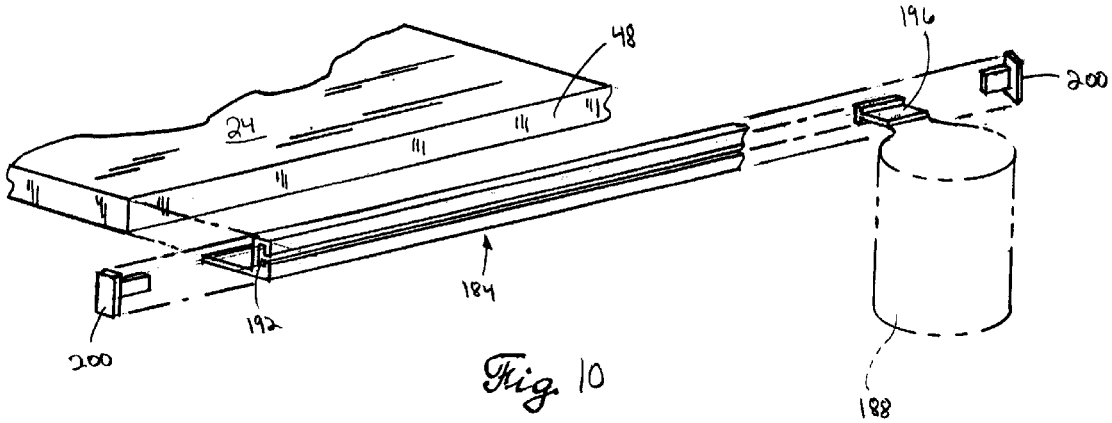
FIG. 10 is an exploded view of an accessory mounting assembly.
Figure 11:
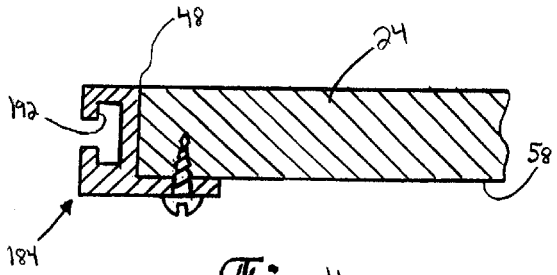
FIG. 11 is an enlarged cross-section view along line 11—11 in FIG. 1.

Referring to FIGS. 10 and 11, the desk 20 may also include accessory attachments 184 mounted to one or both side surfaces 48 of the desk top 24 for selectively mounting accessories 188 (e.g., file hangers, pencil holders (shown in phantom), compact disk and floppy disk organizers, and other office supply organizers) to the desk top 24. The accessory attachments 184 have a generally C-shaped profile and define a T-shaped track 192. The accessories include T-shaped ends 196 that are captured within and slidable along the T-shaped track 192. The T-shaped end 196 is thus captured and prevented from separating from the track due to jiggling, vibrations, or other movement of the accessories. End caps 200 may be inserted into the ends of the T-shaped track 192 to prevent the T-shaped end 196 from sliding out the end of the T-shaped track 192.

Figure 15B:
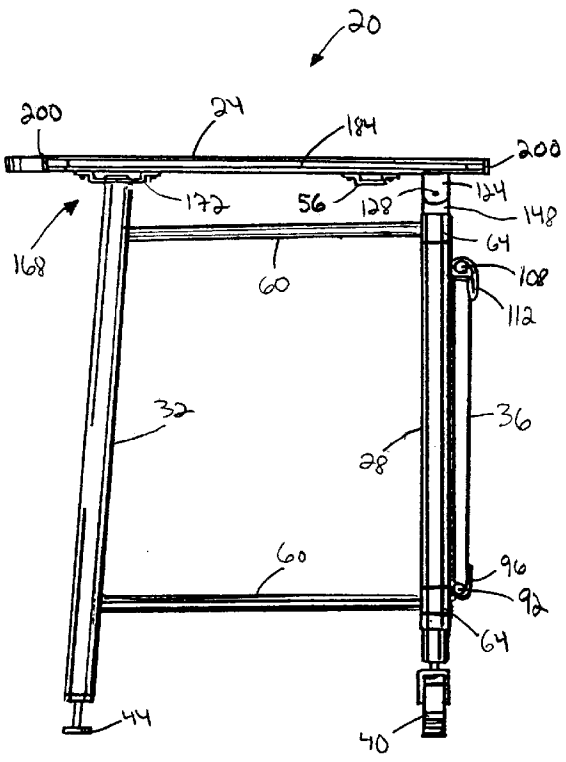
FIG. 15B is a side view of the folding desk in FIG. 15A.
Figure 15A:
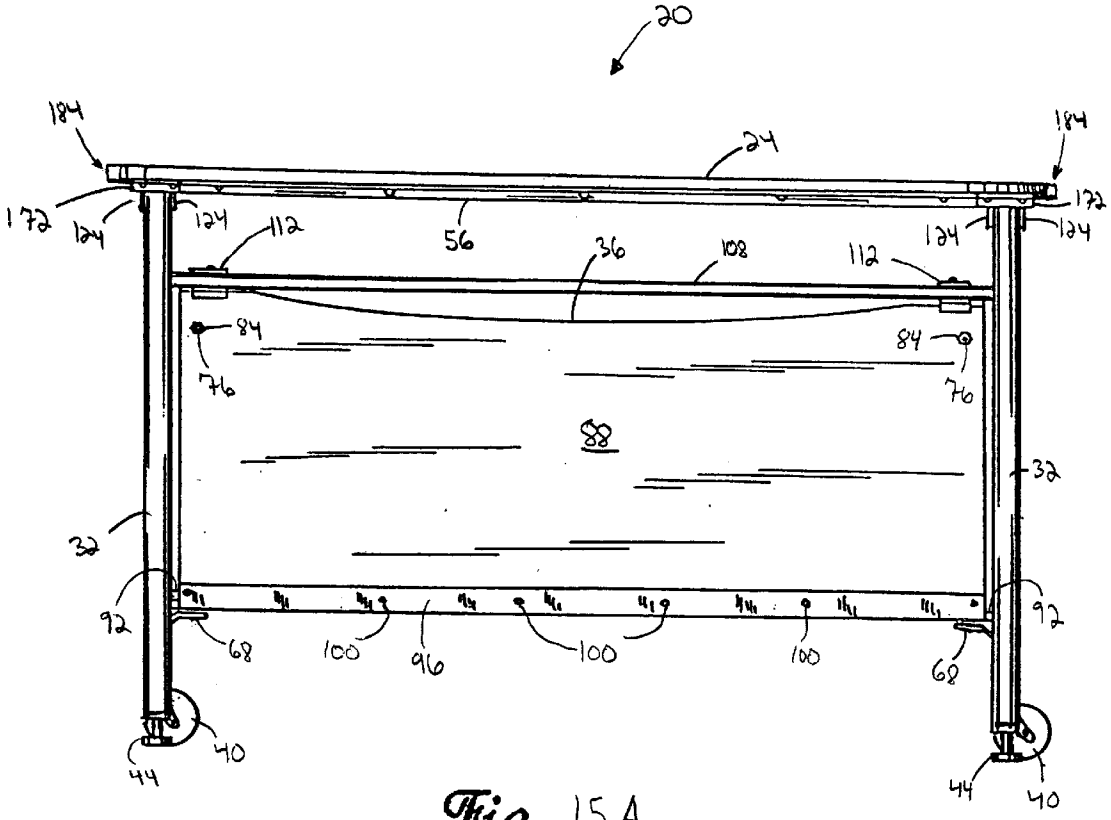
FIG. 15A is a front view of the folding desk with a shelf of the folding desk in a folded condition.

Now that the structural components of the folding desk 20 have been discussed, the folding operation of the desk 20 (illustrated in FIGS. 15–17) will be discussed. Referring to FIGS. 15A and 15B, the shelf 36 and u-shaped bracket 96 are rotated with respect to the pivot bar 92 until the shelf 36 is resiliently held by the resilient clips 112 in a folded orientation substantially perpendicular to a working orientation of the shelf 36. The pivot bar 92 and cross beam 108 are mounted to the back side of the rear legs 28, therefore, the shelf 36 is positioned behind the rear legs 28 in the folded orientation (illustrated best in FIG. 15B). As the shelf 36 is rotated from the working orientation to the folded orientation, the pins 76 are removed from the apertures 72 in the support brackets 68 to permit the front legs 32 to pivot with respect to the rear legs 28.

Figure 16B:
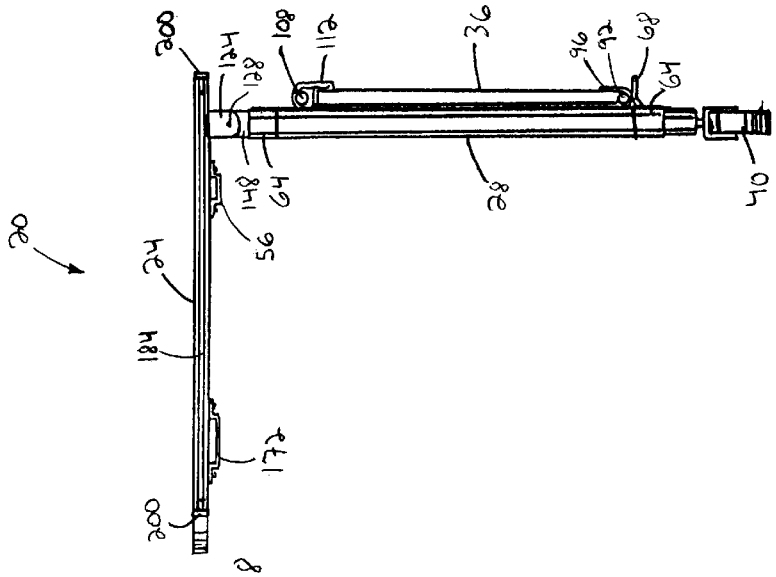
FIG. 16B is a side view of the folding desk in FIG. 16A.
Figure 16A:
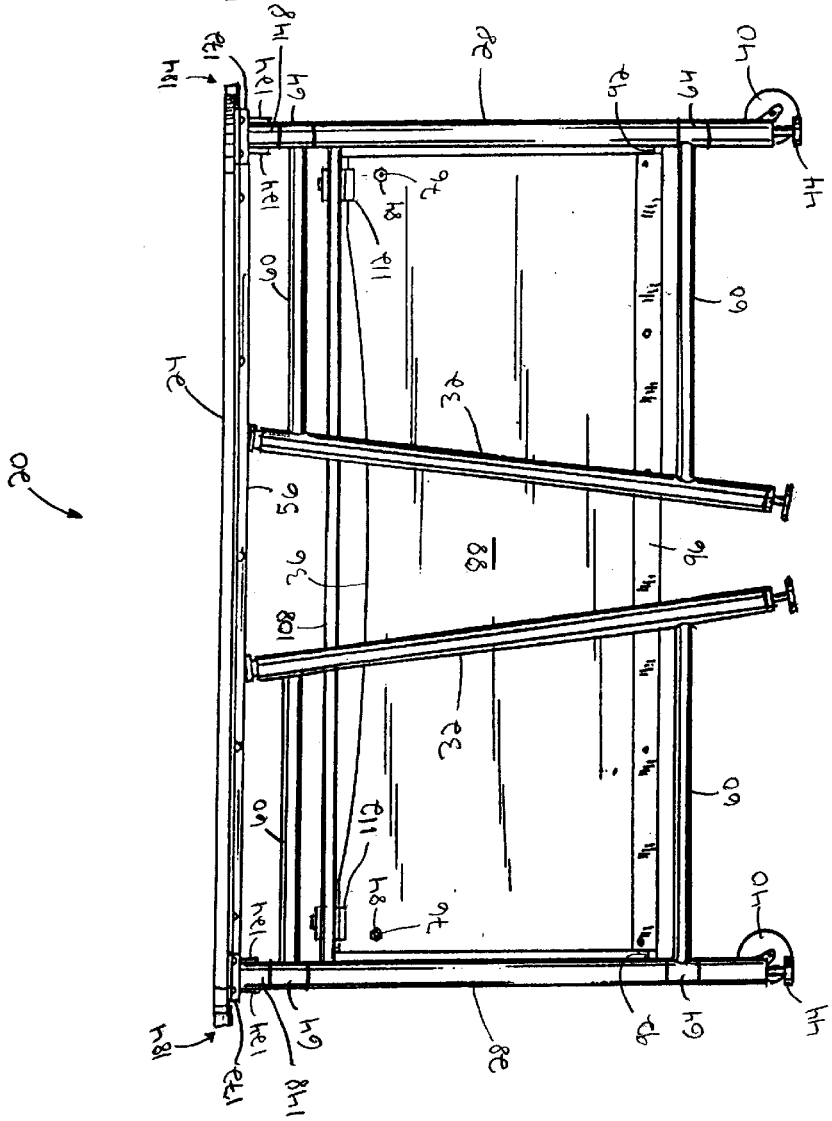
FIG. 16A is a front view of the folding desk with the shelf and front legs in the folded condition.

Referring to FIGS. 16A and 16B, the front legs 32 can pivot about the pivot axis 166 (see FIG. 7) from a working orientation to a folded orientation because the pins 76 are removed from the apertures 72. As the two front legs 32 are pivoted, their tops pivot out of the slots 176 and the grooves 180 disengage the mounting brackets 172. The front and rear legs 32, 28 lie within a single plane, or are substantially within each other's profile, in the folded orientation. As used herein, the term "within each other's profile" means that three of the legs are aligned behind the fourth leg in such a way that the view of the three legs is substantially entirely obstructed by the fourth leg.

Figure 17B:
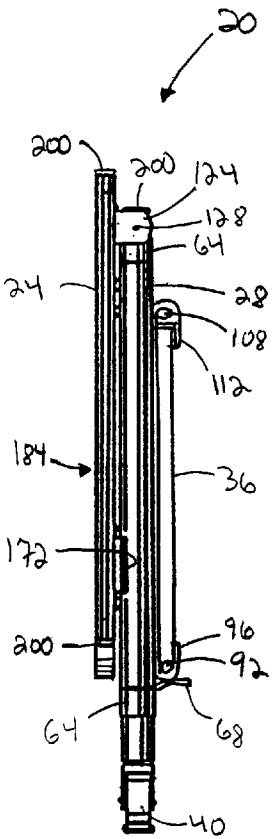
FIG. 17B is a side view of the folding desk in FIG. 17A.
Figure 17A:
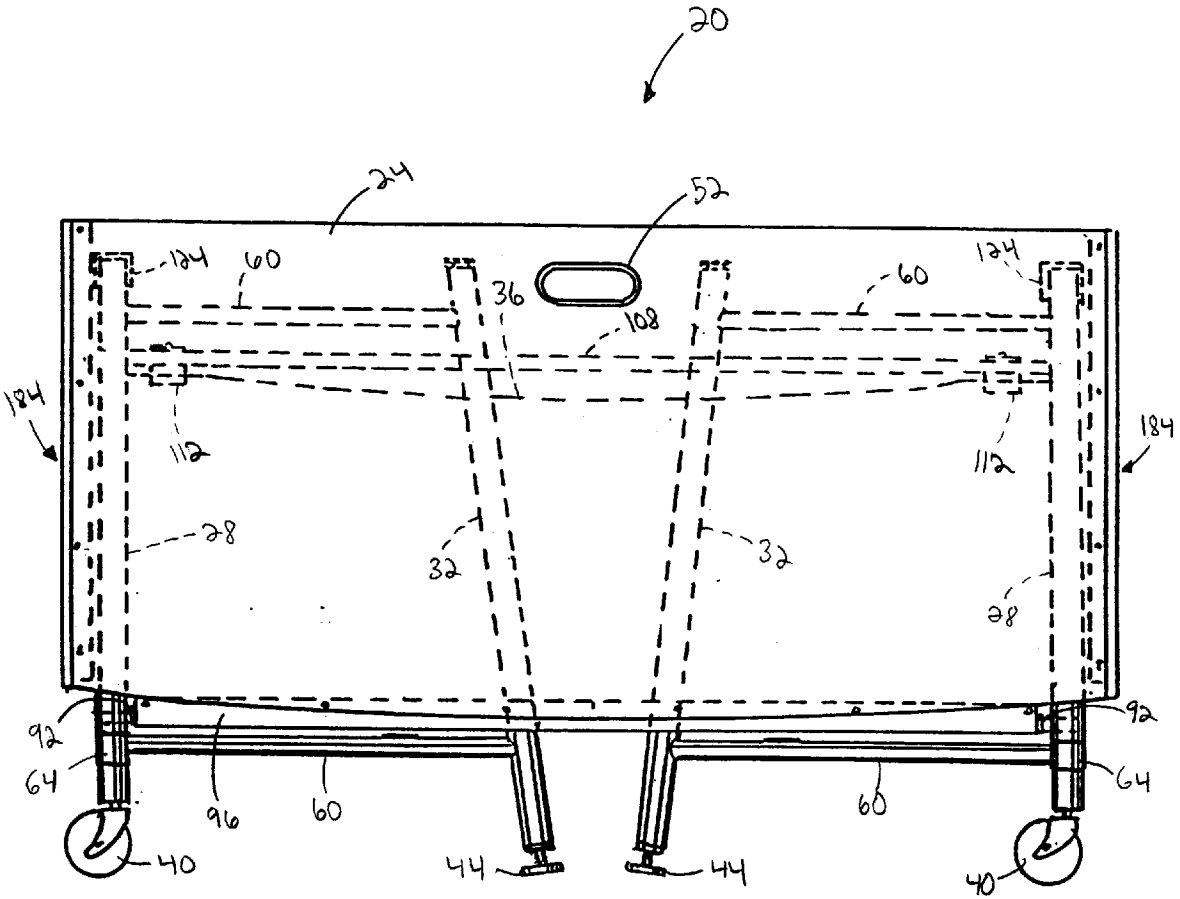
FIG. 17A is a front view of the folding desk in the fully folded condition.

Referring to FIGS. 17A and 17B, the desk top 24 is pivoted from a working orientation to a folded orientation. The folded orientation of the desk top 24 is substantially perpendicular to the working orientation of the desk top 24 and is substantially parallel to the folded orientation of the shelf 36.

In the folded condition, the front and rear legs 32, 28 are between the desk top 24 and the shelf 36, and the cord managing aperture 52 is at the top of the folded desk and can therefore be used as a handle. The wheels 40 remain in contact with the ground surface in the folded condition and the desk 20 can be rolled in the folded condition while grasping the handle afforded by the cord managing aperture 52.

Figure 18:
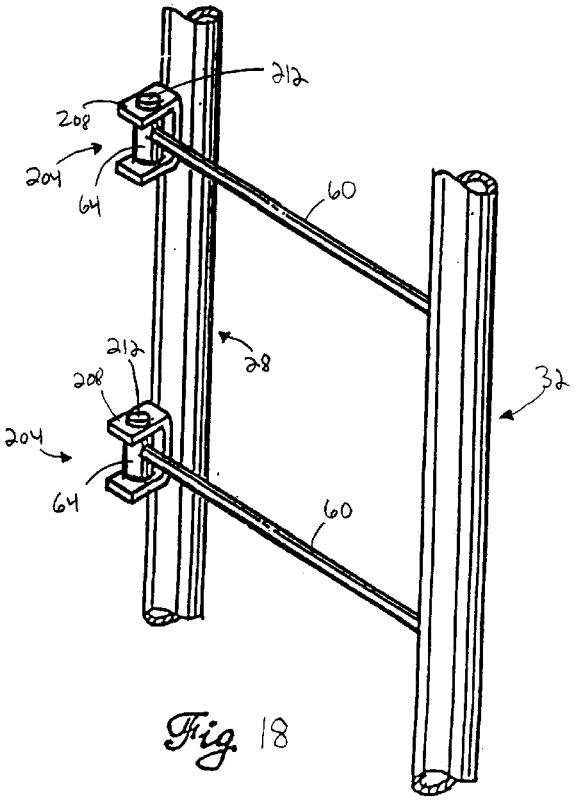
FIG. 18 is a perspective view of an alternative leg construction of the folding desk.
Figure 19:
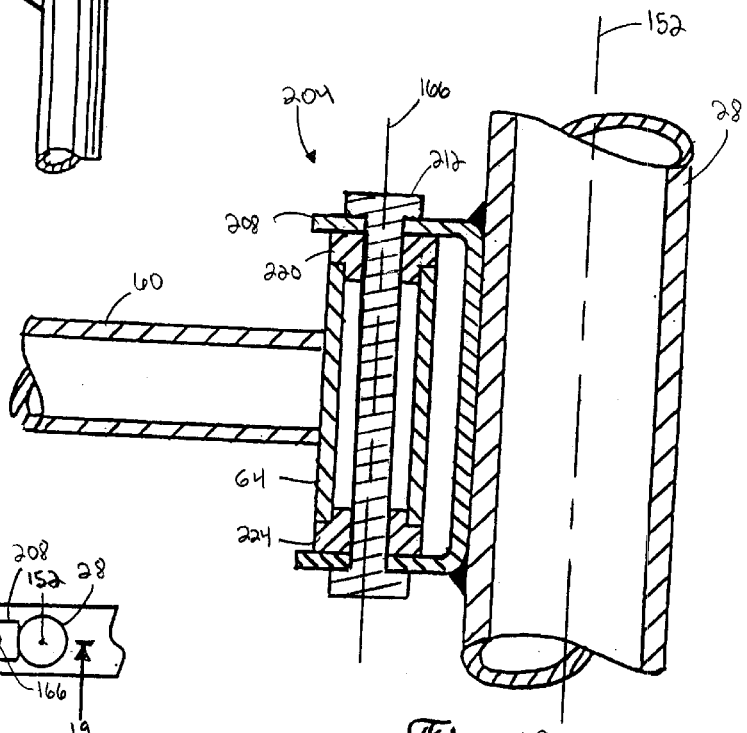
FIG. 19 is a cross-section view along line 19—19 in FIG. 18.
Figure 20:
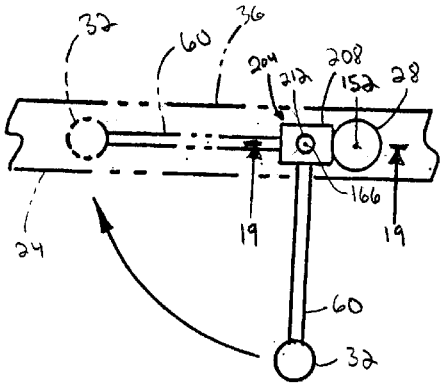
FIG. 20 is a schematic top view of the alternative construction in the folded condition.

Referring to FIGS. 18–20, an alternative construction of the folding desk 20 is illustrated. The alternative construction includes four offset pivotal assemblies 204 (two shown in FIG. 18), one for each collar 64. Each offset pivotal assembly 204 includes an offset bracket 208 mounted to one of the rear legs 28 and an offset pin 212 mounted to the offset bracket 208. The offset pins 212 define the pivot axes 166 in this construction. Each pivot axis 166 extends in a direction substantially parallel to the rear leg longitudinal axes 152 and is offset from the rear leg longitudinal axes 152. Each offset pivotal assembly 204 also includes a plurality of upper offset inserts 220 and a plurality of lower offset inserts 224 for supporting each of the collars 64 such that the collar 64 can pivot about the pivot axis 166.

Referring to FIG. 20, the front leg 32 and the cross member 60 are illustrated in both the working condition (solid lines) and the folded condition (phantom lines). The front leg 32 is pivoted outwardly in the working condition to support the desk top 24 and is pivoted inwardly in the folded condition. In the folded condition, the front leg 32 and rear leg 28 are substantially in a single plane, or in other words, the front leg 32 and the rear leg 28 are substantially within each other's profile. All of the front legs 32 and rear legs 28 are within each other's profile in the folded condition. The front and rear legs 32, 28 are also between the desk top 24 (represented by phantom line 24') and the shelf 36 (represented by phantom line 36') in the folded condition.

Although particular constructions of the present invention have been shown and described, other alternative constructions will be apparent to those skilled in the art and are within the intended scope of the present invention.

What is claimed is:

1. A foldable desk having a working condition and a folded condition, the foldable desk comprising:

a desk top including a cord managing aperture therein, the cord managing aperture permitting cords to pass through the desk top when the desk is in the working condition and useable as a handle when the desk is in the folded condition;

a plurality of legs coupled to the desk top to support the desk top in the working condition, wherein the plurality of legs include two rear legs and two front legs, each rear leg having a rear leg longitudinal axis, and wherein each front leg is pivotally coupled to one of the rear legs for pivotal movement about a pivot axis that is collinear with the associated rear leg longitudinal axis.

2. The foldable desk as claimed in claim 1, wherein the desk top in the working condition is substantially perpendicular to the orientation of the desk top in the folded condition.

3. The foldable desk as claimed in claim 1, wherein the plurality of legs are lying in a single plane in the folded condition and not lying in a single plane in the working condition.

4. The foldable desk as claimed in claim 1, further comprising a wheel mounted to the bottom of each of two of the legs, both of the wheels supporting the desk in both the working condition and the folded condition.

5. A foldable desk having a working condition and a folded condition, the foldable desk comprising:

a desk top including a centrally located cord managing aperture therein, the cord managing aperture permitting cords to pass through the desk top when the desk is in the working condition and useable as a handle when the desk is in the folded condition;

a plurality of legs coupled to the desk top to support the desk top in the working condition; and wherein the plurality of legs include two rear legs and two front legs, the two rear legs being pivotally coupled to the desk top, the two rear legs being pivotal with respect to the desk top about an axis extending substantially parallel to the desk top, the two front legs being releasably coupled to the desk top by a slot-and-groove connection.

6. The foldable desk as claimed in claim 5, wherein the slot-and-groove connection further includes two brackets mounted to the desk top, each bracket including a slot therein, each of the front legs being movable into one of the slots and including a groove defined therein for engaging the associated bracket when the front legs are moved into the slots.

7. A foldable desk having a working condition and a folded condition, the foldable desk comprising:

a desk top including a cord managing aperture therein, the cord managing aperture permitting cords to pass through the desk top when the desk is in the working condition and useable as a handle when the desk is in the folded condition;

a plurality of legs coupled to the desk top to support the desk top in the working condition, wherein the plurality of legs include two rear legs and two front legs, each rear leg having a rear leg longitudinal axis, and wherein each front leg is pivotally coupled to one of the rear legs for pivotal movement about a pivot axis that is not collinear with the associated rear leg longitudinal axis.

8. The foldable desk as claimed in claim 1, further comprising a shelf, the plurality of legs being positionable between the desk top and the shelf in the folded condition.

9. The foldable desk as claimed in claim 1, further comprising a shelf substantially parallel to the desk top in the working condition and in the folded condition.

10. The foldable desk as claimed in claim 1, further comprising a shelf and a resilient clip, the resilient clip for resiliently retaining the shelf in the folded condition.

11. The foldable desk as claimed in claim 1, further comprising a shelf including a bottom surface and a pin extending from the bottom surface, the foldable desk further comprising a bracket coupled to the plurality of legs and including an aperture therein for receiving the pin in the working condition.

12. The foldable desk as claimed in claim 11, wherein the aperture is a slot.

13. A foldable desk having a working condition and a folded condition, the foldable desk comprising:

a desk top including a centrally located cord managing aperture therein, the cord managing aperture permitting cords to pass through the desk top when the desk is in the working condition and useable as a handle when the desk is in the folded condition;

a plurality of legs coupled to the desk top to support the desk top in the working condition; and a shelf, a pivot bar and a u-shaped bracket, the pivot bar being mounted to the plurality of legs and the u-shaped bracket wrapping around at least a portion of the pivot bar and being mounted to the shelf such that the shelf and the u-shaped bracket are rotateable with respect to the pivot bar.

14. The foldable desk as claimed in claim 1, wherein the desk top further includes a side surface, the foldable desk further comprising an accessory attachment mountable to the side surface for attaching accessories thereto.

15. The foldable desk as claimed in claim 1, wherein the accessory attachment includes a c-shaped accessory attachment defining a channel for receiving and retaining a portion of the accessories.

16. A foldable desk having a working condition and a folded condition, the foldable desk comprising:

a desk top movable between a first orientation when the desk is in the working condition and a second orientation when the desk is in the folded condition; and a plurality of legs coupled to the desk top to support the desk top in the working condition, the plurality of legs lying in a single plane in the folded condition and not lying in the single plane in the working condition, wherein the plurality of legs include two rear legs and two front legs, each rear leg having a rear leg longitudinal axis, and wherein each front leg is pivotally coupled to one of the rear legs for pivotal movement about a pivot axis that is collinear with the associated rear leg longitudinal axis.

17. The foldable desk as claimed in claim 16, wherein the desk top in the first orientation is substantially perpendicular to the desk top in the second orientation.

18. The foldable desk as claimed in claim 16, further comprising a shelf, the plurality of legs being positionable between the desk top and the shelf in the folded condition.

19. The foldable desk as claimed in claim 16, further comprising a shelf substantially parallel to the desk top in the working condition and in the folded condition.

20. The foldable desk as claimed in claim 16, further comprising a shelf including a bottom surface and a pin extending from the bottom surface, the foldable desk further comprising a bracket coupled to the plurality of legs and including an aperture therein for receiving the pin in the working condition.

21. The foldable desk as claimed in claim 20, wherein the aperture is a slot.

22. A foldable desk having a working condition and a folded condition, the foldable desk comprising:

a desk top movable between a first orientation when the desk is in the working condition and a second orientation when the desk is in the folded condition;

a plurality of legs coupled to the desk top to support the desk top in the working condition and including two rear legs and two front legs, the two rear legs being pivotally coupled to the desk top and one of the front legs being coupled to one of the rear legs and the other of the front legs being coupled to the other of the rear legs, the plurality of legs lying substantially in a single plane in the folded condition and not lying in the single plane in the working condition; and wherein the desk top is pivotal with respect to the two rear legs about an axis extending substantially parallel to the desk top, the two front legs being releasably coupled to the desk top by a slot-and-groove connection.

23. The foldable desk as claimed in claim 22, wherein the slot-and-groove connection further includes two brackets mounted to the desk top, each bracket including a slot therein, each of the front legs being movable into one of the slots and including a groove defined therein for engaging the associated bracket when the front legs are moved into the slots.

24. A foldable desk having a working condition and a folded condition, the foldable desk comprising:

a desk top movable between a first orientation when the desk is in the working condition and a second orientation when the desk is in the folded condition;

a plurality of legs coupled to the desk top to support the desk top in the working condition and including two rear legs and two front legs, the two rear legs being pivotally coupled to the desk top and one of the front legs being coupled to one of the rear legs and the other of the front legs being coupled to the other of the rear legs, the plurality of legs lying substantially in a single plane in the folded condition and not lying in the single plane in the working condition; and wherein each rear leg has a rear leg longitudinal axis, and wherein each front leg is pivotally coupled to one of the rear legs for pivotal movement about a pivot axis that is not collinear with the associated rear leg longitudinal axis.

25. A foldable desk having a working condition and a folded condition, the foldable desk comprising:

a desk top movable between a first orientation when the desk is in the working condition and a second orientation when the desk is in the folded condition;

a plurality of legs coupled to the desk top to support the desk top in the working condition and including two rear legs and two front legs, the two rear legs being pivotally coupled to the desk top and one of the front legs being coupled to one of the rear legs and the other of the front legs being coupled to the other of the rear legs, the plurality of legs lying substantially in a single plane in the folded condition and not lying in the single plane in the working condition; and a shelf, a pivot bar and a u-shaped bracket, the pivot bar being mounted to the plurality of legs and the u-shaped bracket wrapping around at least a portion of the pivot bar and being mounted to the shelf such that the shelf and the u-shaped bracket are rotateable with respect to the pivot bar.

26. A foldable desk having a working condition and a folded condition, the foldable desk comprising:

a desk top;

a shelf being substantially parallel to the desk top in the working condition and the folded condition; and a plurality of legs coupled to the desk top to support the desk top in the working condition, the plurality of legs positionable between the desk top and the shelf in the folded condition, wherein the plurality of legs include two rear legs and two front legs, each rear leg having a rear leg longitudinal axis, and wherein each front leg is pivotally coupled to one of the rear legs for pivotal movement about a pivot axis that is collinear with the associated rear leg longitudinal axis.

27. The foldable desk as claimed in claim 26, wherein the desk top in the working condition is substantially perpendicular to the orientation of the desk top in the folded condition.

28. The foldable desk as claimed in claim 26, wherein the plurality of legs are lying in a single plane in the folded condition and not lying in a single plane in the working condition.

29. The foldable desk as claimed in claim 26, further comprising a shelf and a resilient clip, the resilient clip for resiliently retaining the shelf in the folded condition.

30. The foldable desk as claimed in claim 26, further comprising a shelf including a bottom surface and a pin extending from the bottom surface, the foldable desk further comprising a bracket coupled to the plurality of legs and including an aperture therein for receiving the pin in the working condition.

31. A foldable desk having a working condition and a folded condition, the foldable desk comprising:

a desk top;

a shelf being substantially parallel to the desk top in the working condition and the folded condition;

a plurality of legs coupled to the desk top to support the desk top in the working condition, the plurality of legs positionable between the desk top and the shelf in the folded condition; and wherein the plurality of legs include two rear legs and two front legs, the two rear legs being pivotally coupled to the desk top, the two rear legs being pivotal with respect to the desk top about an axis extending substantially parallel to the desk top, the two front legs being releasably coupled to the desk top by a slot-and-groove connection.

32. A foldable desk having a working condition and a folded condition, the foldable desk comprising:

a desk top;

a shelf being substantially parallel to the desk top in the working condition and the folded condition;

a plurality of legs coupled to the desk top to support the desk top in the working condition, the plurality of legs positionable between the desk top and the shelf in the folded condition: and a pivot bar and a u-shaped bracket, the pivot bar being mounted to the plurality of legs and the u-shaped bracket wrapping around at least a portion of the pivot bar and being mounted to the shelf such that the shelf and the u-shaped bracket are rotateable with respect to the pivot bar.

33. A foldable desk having a working condition and a folded condition, the foldable desk comprising:

a desk top;

a plurality of leg assemblies supporting the desk top in the working condition, each leg assembly including a rear leg and a front leg, the desk top being pivotally connected to the rear legs, the leg assemblies being pivotal with respect to the desk top to a position where the leg assemblies lie in a common plane in the folded condition; and wherein the desk top includes a plurality of brackets connected to the desk top and corresponding to each leg assembly, each bracket defining a slot and each front leg defining a groove engageable with the corresponding slot to rigidly connect the leg assembly to the desk top in the working condition.

34. The foldable desk of claim 33, wherein the plurality of leg assemblies includes a first leg assembly and a second leg assembly connected to opposite ends of the desk top, the distance from the rear leg to the front leg of each leg assembly being less than half the distance from the first leg assembly to the second leg assembly.

35. The foldable desk of claim 33, further comprising a shelf pivotally connected to a lower portion of the rear legs.

36. The foldable desk of claim 35, wherein the leg assemblies are positioned between the desk top and the shelf in the folded condition.

37. The foldable desk of claim 33, wherein the desk top defines a second plane forward of the common plane of the leg assemblies in the folded condition.

38. A desk comprising:

a desk top;

a plurality of leg assemblies supporting the desk top and the desk top extending outwardly beyond the leg assemblies, each leg assembly having a rear portion pivotally connected to the desk top and a front portion connectable to the desk top, each leg assembly being pivotal about a respective leg axis and the desk top being pivotal relative to the leg assemblies about a desk top axis, each respective leg axis being substantially transverse to the desk top axis;

a fastener releasably connecting the front portion to the desk top; and wherein the fastener includes a plurality of brackets connected to the desk top and corresponding to each leg assembly, each bracket defining a slot and each front portion defining a groove engageable with the corresponding slot to rigidly connect the leg assembly to the desk top.

39. The desk of claim 38, further comprising a shelf pivotally connected to the leg assemblies.

* * * * *